United States Patent [19]

Choquer et al.

[11] Patent Number: 4,617,571

[45] Date of Patent: Oct. 14, 1986

[54] TUNED BAND-SWITCHING LOOP ANTENNA

[75] Inventors: Jean Choquer, Gif sur Yvette; Thierry Gartner, Briis Sous Forges, both of France

[73] Assignee: Societe Technique d'Applicatioon et de Recherche Electronique, France

[21] Appl. No.: 603,472

[22] Filed: Apr. 24, 1984

[30] Foreign Application Priority Data

Apr. 27, 1983 [FR] France ..... 83 06948

[51] Int. Cl.[4] ..... H01Q 11/12

[52] U.S. Cl. ..... 343/744

[58] Field of Search ..... 343/741, 742, 743, 744, 343/748

[56] References Cited

U.S. PATENT DOCUMENTS

| | | | |
|---|---|---|---|
| 3,587,102 | 6/1971 | Czerwinski | 343/744 |
| 3,680,127 | 7/1972 | Richard | 343/748 |
| 4,518,965 | 5/1985 | Hidaka | 343/744 |

*Primary Examiner*—Eli Lieberman

*Attorney, Agent, or Firm*—Alan H. MacPherson; Steven F. Caserza; Kenneth E. Leeds

[57] ABSTRACT

The invention relates to a loop antenna tuned by means of a variable capacitor.

The antenna includes, in parallel with the variable capacitor (4), a switchable state variable inductor (11).

The invention is particularly applicable to antennas for HF radio links at powers of up to 1 kW.

3 Claims, 5 Drawing Figures

TUNED BAND-SWITCHING LOOP ANTENNA

The invention relates to improvements to a high frequency (HF) loop antenna which is tuned by means of a variable capacitor.

It is particularly applicable to antennas for HF links using powers of up to 1 kW.

In this type of antenna, the ratio between the highest and the lowest possible tuned frequencies is directly related to the value of the ratio between maximum and minimum capacitance values of the tuning capacitor. In practice, this ratio is limited by the fact that the minimum capacitance value cannot be reduced below a residual value.

The invention aims to provide an antenna having good efficiency over a wide range of frequencies.

In accordance with the invention, this is achieved by placing an inductor in parallel with the capacitor and by associating means with the inductor for putting it in and out of circuit.

Such an antenna operates in one or other of two frequency ranges depending on whether the inductor is in operation or out of operation. The inductor thus enables the range of frequencies over which the antenna can be tuned to be increased.

There follows a description of an embodiment of the invention, giving a preferred, but not a limiting description of the scope of the invention, and given with reference to the figures of the accompanying drawing, the description and the figures bringing out other features of the invention.

Figure 1:
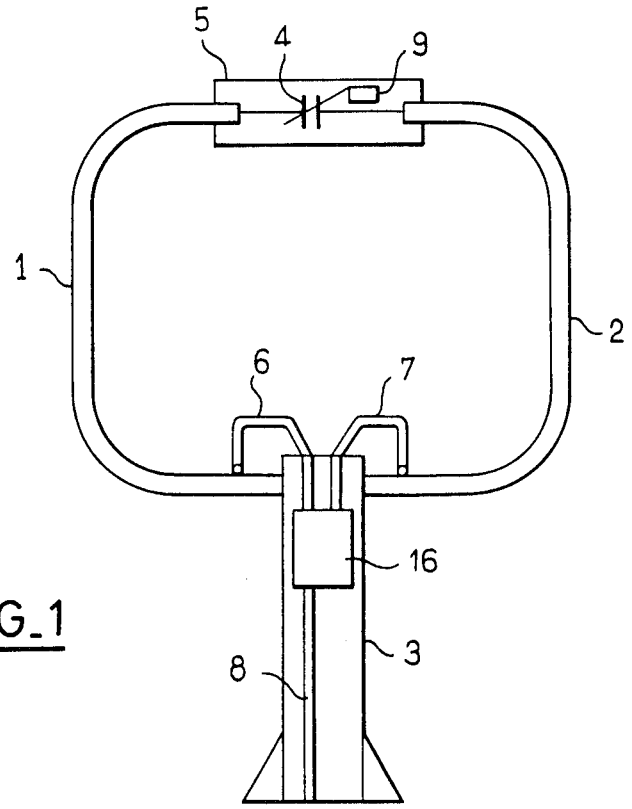
FIG. 1 is a diagram of an antenna to which the invention is applicable.

The antenna shown in FIG. 1 has two vertical arms 1 and 2, eg. hollow tubes, which are fixed to a metal stand or support 3. The two arms 1 and 2 constitute a radiating loop and are interconnected at the top by a variable capacitor shown diagrammatically at 4. The capacitor 4 is housed in an insulating cylinder 5. The antenna is fed from a coaxial cable 8 lodged in the stand via a balun 16 and two secondary half loops 6 and 7. The capacitor is varied by means of a motor 9 lodged in the cylinder.

In this example, the loop formed by the two arms is substantially square; this shape is not essential, and, in a variant, a circular loop may be used such as described, for example, in U.S. Pat. No. 3,588,905 may be used. Loops of other shapes are also possible.

In this example, the main loop is fed via two secondary half loops; this is not essential, and in a variant, a single secondary loop may be used, eg. a circular secondary loop as described in the above-mentioned U.S. Pat. No. 3,588,905.

Figure 2:
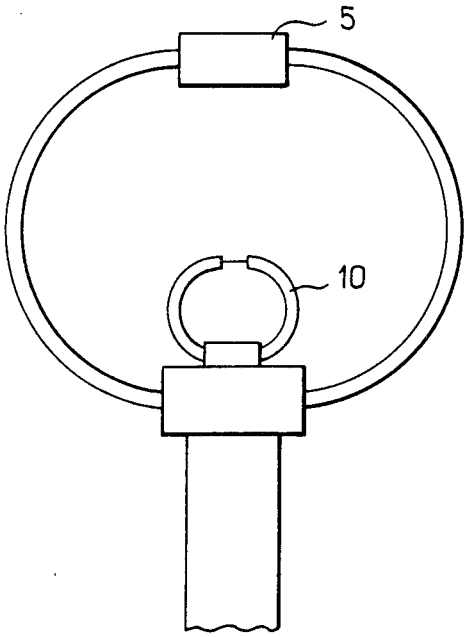
FIG. 2 is a diagram of a variant antenna to which the invention is applicable.

By way of remainder, FIG. 2 shows a loop antenna of the type described in U.S. Pat. No. 3,588,905 in which the secondary loop is referenced 10.

The embodiments shown in FIGS. 1 and 2 are shown merely as examples of the types of antennas to which the invention may be applied. In particular, the invention is not only applicable to antennas having a single loop completely situated in one plane.

Figure 3:
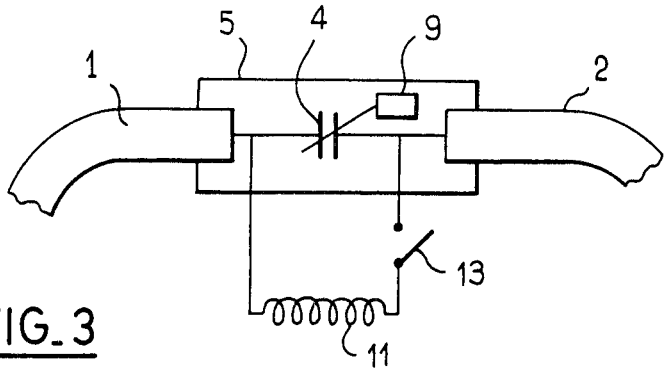
FIG. 3 is a circuit diagram of the improvement applied in accordance with the invention to the antennas shown in FIGS. 1 and 2.

In accordance with the invention, the antennas shown in FIGS. 1 and 2 are improved (see FIG. 3) by connecting a switchable state inductor 11 in parallel with the variable capacitor 4.

"Switchable state inductor" is used to designate an inductor which can be switched in and out of circuit at will. This control is represented diagrammatically in FIG. 3 by a switch.

The inductor is preferably located in the air.

Figure 4:
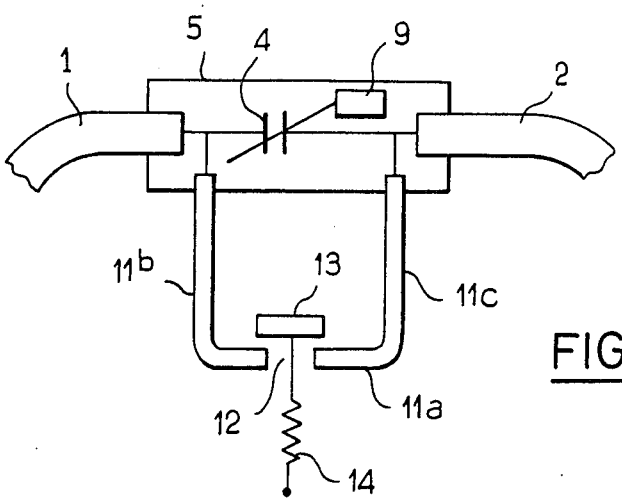
FIG. 4 is a detail view of one implementation of the improvement in accordance with the invention.

In a preferred embodiment (see FIG. 4), the inductor is constituted by a metal tube which constitutes a short-circuited two-wire [transmission] line. This is preferred over a coiled inductor which would consume too much energy. The tube 11 comprises a bottom branch 11*a* (ie. relative to the capacitor) which is connected to the terminals of the capacitor via branches 11*b* and 11*c*.

Figure 5:
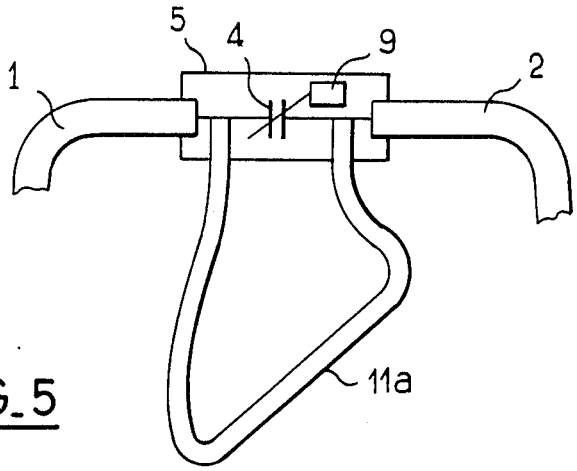
FIG. 5 is a detail view of a variant implementation of the improvement in accordance with the invention.

Advantageously (see FIG. 5), the short-circuited two-wire line is disposed in a plane which is perpendicular to the plane of the main loop in order to reduce mutual coupling.

In order to control the state of the inductor, the tube is provided with a cut 12 (eg. in its bottom branch 11*a*, thereby maintaining antenna symmetry), and a relay 13 is placed to control at will the short-circuiting of the two ends of the tube which delimit the cut between them. The relay 13 is under the control of an electromagnet represented diagrammatically at 14.

Establishing a short circuit corresponds to putting the inductor into service.

The invention is not limited to these means in particular for switching the state of the inductor.

EXAMPLE

A 1 kW loop antenna which operates, without the inductor, over a low frequency range of 3 to 13.2 MHz, is provided, by putting the inductor into service, with a frequency sub-range of 13.2 to 29 MHz.

We claim:

1. A loop antenna comprising:

two arms extending in a first vertical plane and interconnected at their top ends to form a loop by a variable capacitor;

feeding and coupling means to make said loop radiate electromagnetic energy;

an inductor connected in parallel with said variable capacitor, said inductor being formed by a two-wire line having an open end which can be short circuited; and switching means for selectively short circuiting said open end of said two-wire line.

2. The loop antenna of claim 1, wherein said two-wire line extends in a second vertical plane perpendicular to said first vertical plane, the top ends of the wires in said two-wire line being connected one to each end of said variable capacitor and the bottom ends of said wires forming said open end of said two-wire line.

3. The loop antenna of claim 2, wherein said two-wire line is made of a vertically oriented folded metal tube, said bottom ends of said wires being formed from a cut through the bottom branch of said folded metal tube, said cut being capable of being selectively short circuited by said switching means.

* * * * *

UNITED STATES PATENT AND TRADEMARK OFFICE

CERTIFICATE OF CORRECTION

PATENT NO. : 4,617,571

DATED : October 14, 1986

INVENTOR(S) : Jean Choquer and Thierry Gartner

It is certified that error appears in the above-identified patent and that said Letters Patent is hereby corrected as shown below:

On the title page assignee should read

--(73) Assignee: Societe Technique d'Application et de Recherche Electronique --.

Signed and Sealed this

Third Day of March, 1987

*Attest:*

DONALD J. QUIGG

*Attesting Officer*

*Commissioner of Patents and Trademarks*